US009947440B2

(12) United States Patent
Sekido

(10) Patent No.: US 9,947,440 B2
(45) Date of Patent: Apr. 17, 2018

(54) MOUNTING CABLE AND METHOD FOR MANUFACTURING MOUNTING CABLE

(71) Applicant: OLYMPUS CORPORATION, Tokyo (JP)

(72) Inventor: Takanori Sekido, Machida (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 15/643,028

(22) Filed: Jul. 6, 2017

(65) Prior Publication Data

US 2017/0301433 A1 Oct. 19, 2017

Related U.S. Application Data

(63) Continuation of application No. PCT/JP2015/050680, filed on Jan. 13, 2015.

(51) Int. Cl.
*H01B 11/18* (2006.01)
*H01B 7/02* (2006.01)
(Continued)

(52) U.S. Cl.
CPC ..... *H01B 11/1895* (2013.01); *H01B 7/0216* (2013.01); *H01R 9/05* (2013.01); *H01R 12/61* (2013.01); *H01R 43/0256* (2013.01)

(58) Field of Classification Search
CPC .... H01B 11/1895; H01B 7/0216; H01R 9/05; H01R 12/61; H01R 43/0256
(Continued)

(56) References Cited

U.S. PATENT DOCUMENTS 4,051,323 A * 9/1977 Churla ..... H01R 9/0512 174/78
4,861,275 A * 8/1989 Cross ..... H01R 23/667 439/289
(Continued)

FOREIGN PATENT DOCUMENTS

JP 2003-178826 A 6/2003
JP 2008-112699 A 5/2008
(Continued)

OTHER PUBLICATIONS

International Search Report dated Apr. 14, 2015 issued in PCT/JP2015/050680.

*Primary Examiner* — Timothy Thompson
*Assistant Examiner* — Charles Pizzuto
(74) *Attorney, Agent, or Firm* — Scully, Scott, Murphy & Presser, P.C.

(57) ABSTRACT

A mounting cable includes: a coaxial cable including: a core wire made of a conductive material; an internal insulator covering an outer periphery of the core wire; a shield covering an outer periphery of the internal insulator; and a jacket covering an outer periphery of the shield with an insulator, the coaxial cable having one end portion on which the core wire, the internal insulator and the shield are exposed; a cable fixing unit that fixes one end portion of the exposed core wire and has a connection surface on which an end face of the core wire is exposed; and a conductor having one end electrically and mechanically connected to the exposed shield and having the other end fixed to the cable fixing unit. An end portion of the conductor is exposed on the connection surface of the cable fixing unit.

10 Claims, 11 Drawing Sheets

(51) Int. Cl.
*H01R 43/02* (2006.01)
*H01R 9/05* (2006.01)
*H01R 12/61* (2011.01)

(58) Field of Classification Search
USPC ..... 174/74 R
See application file for complete search history.

(56) References Cited

U.S. PATENT DOCUMENTS

| | | | | |
|---|---|---|---|---|
| 7,973,239 | B2 | 7/2011 | Koyama et al. | |
| 8,912,445 | B2 | 12/2014 | Sekido et al. | |
| 2012/0149238 | A1* | 6/2012 | Negishi | A61B 1/042 439/579 |
| 2015/0060103 | A1* | 3/2015 | Vinther | H01R 9/032 174/78 |

FOREIGN PATENT DOCUMENTS

| | | | |
|---|---|---|---|
| JP | 2011-023134 | A | 2/2011 |
| JP | 2012089288 | * | 5/2012 |
| JP | 5326574 | B2 | 10/2013 |

* cited by examiner

MOUNTING CABLE AND METHOD FOR MANUFACTURING MOUNTING CABLE

CROSS REFERENCES TO RELATED APPLICATIONS

This application is a continuation of PCT international application Ser. No. PCT/JP2015/050680, filed on Jan. 13, 2015 which designates the United States, incorporated herein by reference.

BACKGROUND

1. Technical Field

The disclosure relates to a mounting cable and a method for manufacturing the mounting cable.

2. Related Art

In recent years, medical and industrial endoscopes have been widely used. As the medical endoscope, for example, there is a medical endoscope provided with an imaging device with a built-in image sensor such as a CCD at a distal end of an insertion portion into a body. By deeply inserting the insertion portion into the body, it is possible to observe a lesion part, and further, by using a treatment tool together as needed, it is possible to examine and treat the inside of the body.

In such an endoscope, miniaturization and high performance of the imaging device have been studied for the purpose of acquiring a reduction in burden on a subject or image information with less noise. However, along with this, it is desired to reduce the diameter of cables which transmit image signals or clock signals or supply the drive power to the image sensor.

As a technique for easily connecting a plurality of the cables with reduced diameter, a technique for fixing a plurality of coaxial cables to a base so that end portions of the coaxial cables are aligned in a predetermined arrangement, and exposing the core wires of the coaxial cables and an end face of a shield to the end face of the base, and connecting the core wires and the end face to a core wire connection electrode and a ground electrode of a substrate, respectively (for example, refer to JP 2003-178826 A).

SUMMARY

In some embodiments, a mounting cable includes: a coaxial cable including: a core wire made of a conductive material; an internal insulator covering an outer periphery of the core wire; a shield covering an outer periphery of the internal insulator; and a jacket covering an outer periphery of the shield with an insulator, the coaxial cable having one end portion on which the core wire, the internal insulator and the shield are exposed; a cable fixing unit that fixes one end portion of the exposed core wire and has a connection surface on which an end face of the core wire is exposed; and a conductor having one end electrically and mechanically connected to the exposed shield and having the other end fixed to the cable fixing unit. An end portion of the conductor is exposed on the connection surface of the cable fixing unit.

In some embodiments, a method for manufacturing a mounting cable includes: forming a bump electrode on an end portion of a substrate, the substrate having an insulating base material and having a ground pattern on one surface of the insulating base material; electrically and mechanically connecting one end of a conductor to a shield of a coaxial cable, the coaxial cable having a core wire, an internal insulator and the shield and having one end portion on which the core wire, the internal insulator and the shield are exposed; connecting the other end of the conductor to the ground pattern of the substrate; fixing the core wire and the substrate with a cable fixing unit after aligning the core wire and the substrate; and cutting the cable fixing unit to expose the core wire and the bump electrode.

The above and other features, advantages and technical and industrial significance of this invention will be better understood by reading the following detailed description of presently preferred embodiments of the invention, when considered in connection with the accompanying drawings.

DETAILED DESCRIPTION

Figure 1:
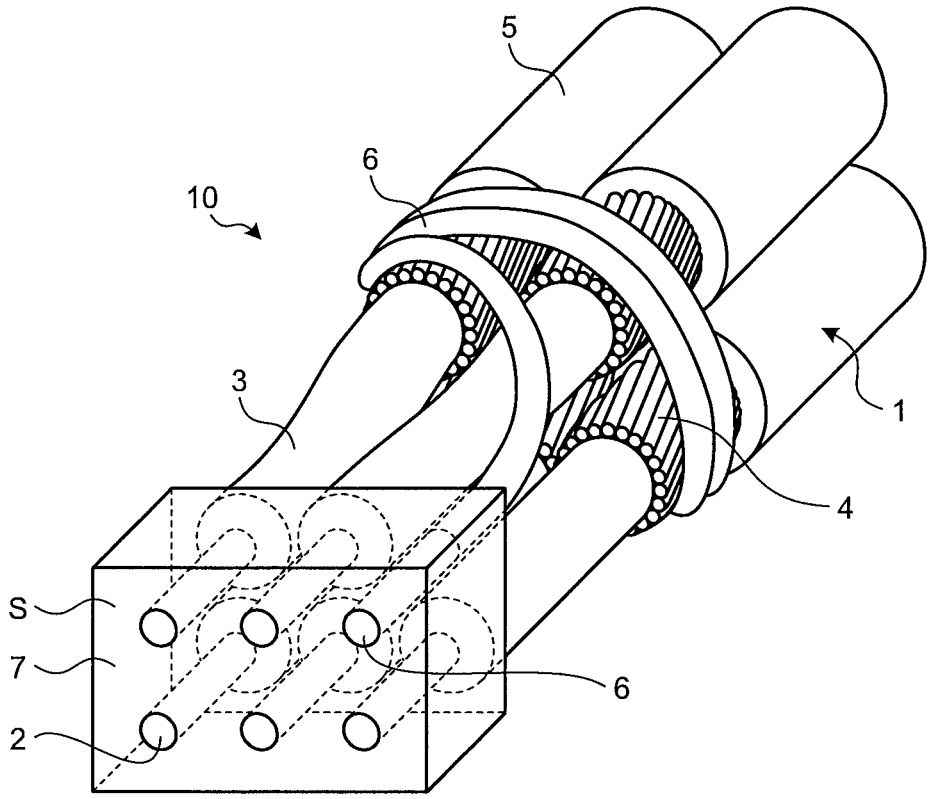
FIG. 1 is a perspective view of a mounting cable according to a first embodiment of the present invention.

Exemplary embodiments of the present invention will be described below with reference to the accompanying drawings. The present invention is not limited by the embodiment. The same reference signs are used to designate the same elements throughout the drawings. The drawings are schematic, a relation between the thickness and the width of each member, the ratio of each member, and the like are different from the reality. Portions with different relations or ratios between the dimensions are also included in the drawings.

First Embodiment

Figure 2:
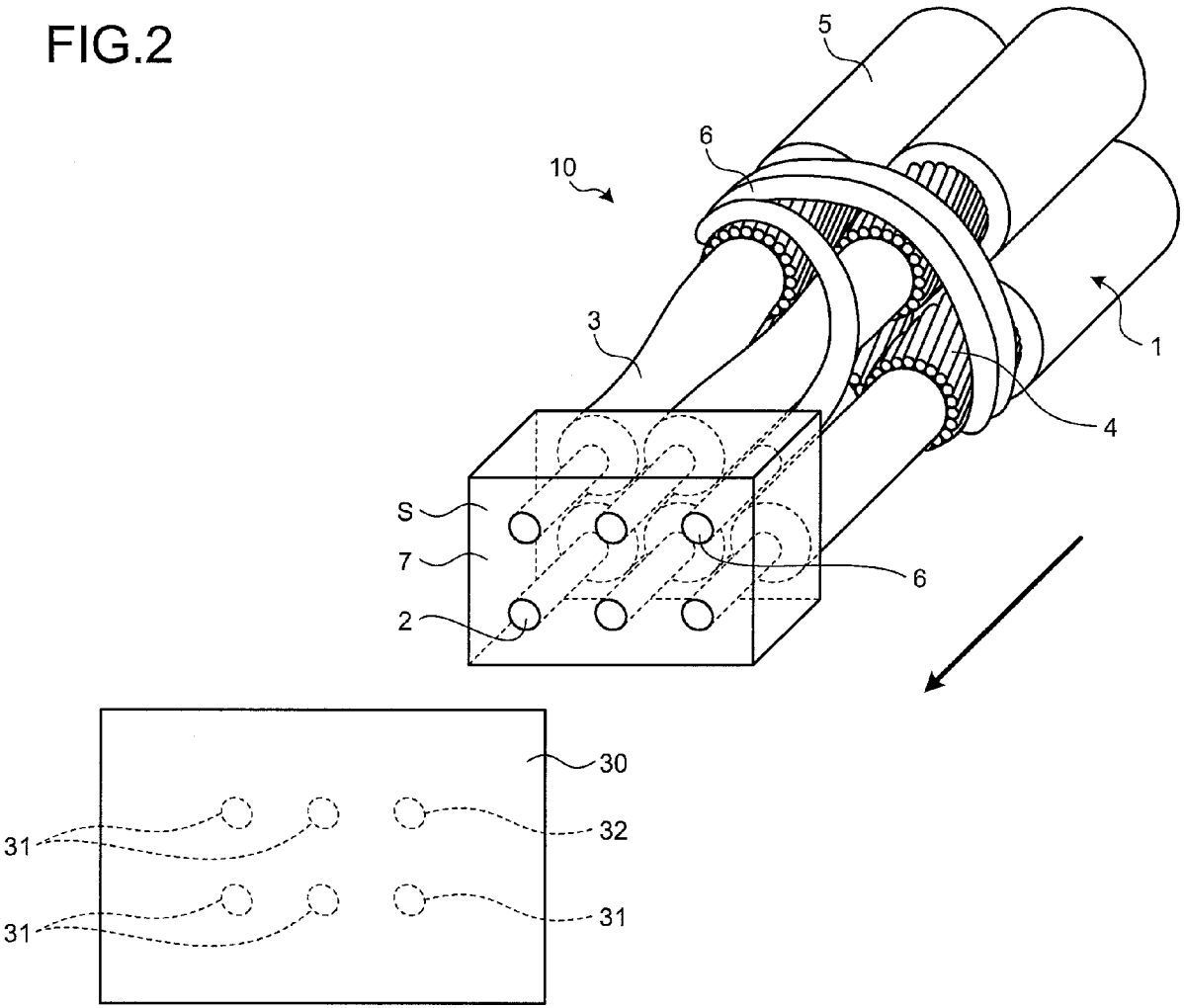
FIG. 2 is a schematic view illustrating the connection of the mounting cable of FIG. 1 to a substrate.

First, a mounting cable according to the first embodiment will be described. FIG. 1 is a perspective view of a mounting cable according to a first embodiment of the present invention. FIG. 2 is a schematic view illustrating connection of the mounting cable of FIG. 1 to a substrate.

As illustrated in FIG. 1, a mounting cable 10 according to the first embodiment includes a coaxial cable 1, a conductor 6, and a cable fixing unit 7.

The coaxial cable 1 includes a core wire 2 made of a conductive material, an internal insulator 3 which covers the outer periphery of the core wire 2, a shield 4 which covers the outer periphery of the internal insulator 3 with a plurality of metal wires, and a jacket 5 which covers the outer periphery of the shield 4 with an insulator. The internal insulator 3, the shield 4 and the jacket 5 are peeled at the distal end portion of the coaxial cable 1 so that the core wire 2, the internal insulator 3 and the shield 4 are exposed, respectively. The mounting cable 10 according to the first embodiment has five coaxial cables 1, but the number of the coaxial cables 1 is not limited thereto.

The conductor 6 is a conductive wire made of metal or alloy having excellent conductivity, and has one end wound around an outer periphery of the exposed portion of the shield 4 for fixation. The conductor 6 is electrically and mechanically connected to the shield 4 by solder (not illustrated) or the like. Copper wire, copper-coated steel wire, nickel wire, copper nickel wire or tin-plated, nickel-plated, or silver-plated products, and the like of various metal wires can be used as the conductor 6. The outer diameter of the conductor 6 is preferably equal to or less than the thickness of the jacket 5. The conductor 6 is wound so as to be in contact with the shields 4 of the five coaxial cables 1. However, if the shields 4 are in contact with each other, the conductor 6 does not need to be in contact with all the shields 4.

The cable fixing unit 7 fixes the exposed core wire 2 and the other end of the conductor 6. In the first embodiment, the cable fixing unit 7 fixes the core wire 2 and the conductor 6 in upper and lower two stages at predetermined intervals, preferably, at right and left equal intervals. The cable fixing unit 7 has a rectangular parallelepiped shape, and the cross-sections of the end portions of the core wire 2 and the conductor 6 are exposed on the connection surface S of the cable fixing unit 7 perpendicular to the axial direction of the coaxial cable 1. The cable fixing unit 7 is preferably formed of a thermosetting resin having insulation properties, but it is also possible to use a light curable resin such as an ultraviolet curable resin, a naturally curable resin or the like. The thermosetting resin used for the cable fixing unit 7 is preferably an epoxy resin from the viewpoint of adhesiveness.

As illustrated in FIG. 2, the core wire 2 and the conductor 6 exposed on the connection surface S of the cable fixing unit 7 are connected to a core wire connection electrode 31 and a ground electrode 32 provided on a substrate 30, respectively. The core wire 2 and the core wire connection electrode 31 are electrically and mechanically connected to each other by a conductive connecting material, and the conductor 6 and the ground electrode 32 are electrically and mechanically connected to each other by a conductive connecting material.

In the mounting cable 10 according to the first embodiment, since the shield 4 is connected to the ground electrode 32 via the conductor 6 having a larger outer diameter than that of the metal wire forming the shield 4, even when there is a slight positional deviation in a mutual positional relation between the core wire 2 and the conductor 6 exposed on the connection surface S of the cable fixing unit 7, and between the core wire connection electrode 31 and the ground electrode 32 provided on the substrate 30, it is possible to maintain the connection strength. Further, on the connection surface S, the conductor 6 is spaced apart from the core wire 2 and the core wire connection electrode 31 is spaced apart from the ground electrode 32. Thus, it is possible to suppress an occurrence of short circuit or the like.

Further, in the first embodiment, the cable fixing unit 7 directly fixes the core wire 2 to prevent the core wire 2 from coming out of the connection surface S when a stress is applied to the coaxial cable 1. However, as long as the cable fixing unit 7 has a portion which directly fixes the core wire 2, the cable fixing unit 7 may fix not only the core wire 2 but also the internal insulator 3.

Figure 3:
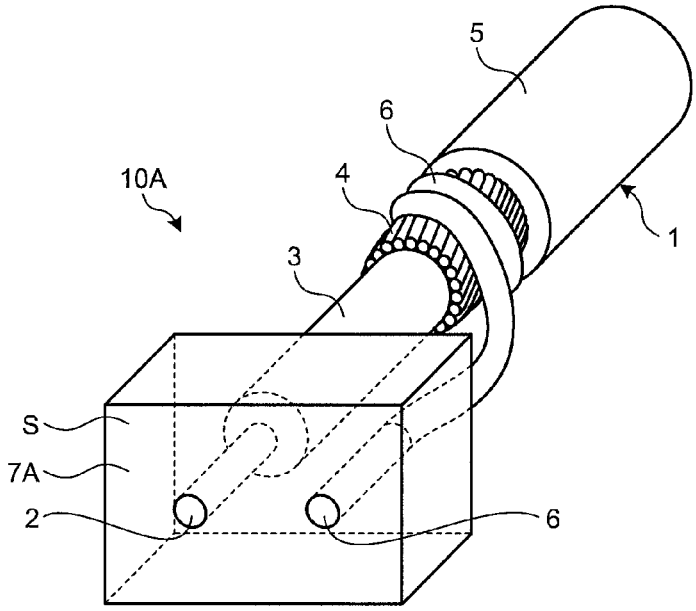
FIG. 3 is a perspective view of a mounting cable according to a first modified example of the first embodiment of the present invention.

Also, the mounting cable may use a single coaxial cable. FIG. 3 is a perspective view of a mounting cable according to a first modified example of the first embodiment of the present invention. A mounting cable 10A according to the first modified example of the first embodiment of the present invention includes a single coaxial cable 1, a conductor 6, and a cable fixing unit 7A. The cable fixing unit 7A fixes the single core wire 2 and the conductor 6. As in the first embodiment, the mounting cable 10A according to the first modified example can connect the shield 4 to the ground electrode via the conductor 6 having the outer diameter larger than that of the metal wire forming the shield 4. Thus, even when there is a slight positional deviation between the core wire 2 and the conductor 6 exposed on the connection surface S of the cable fixing unit 7A, and between the core wire connection electrode and the ground electrode provided on the substrate, it is possible to maintain the connection strength. In addition, since the conductor 6 is spaced apart from the core wire 2 by the cable fixing unit 7A and the core wire connection electrode is spaced apart from the ground electrode by the cable fixing unit 7A, it is possible to suppress an occurrence of short circuit or the like.

Figure 4:
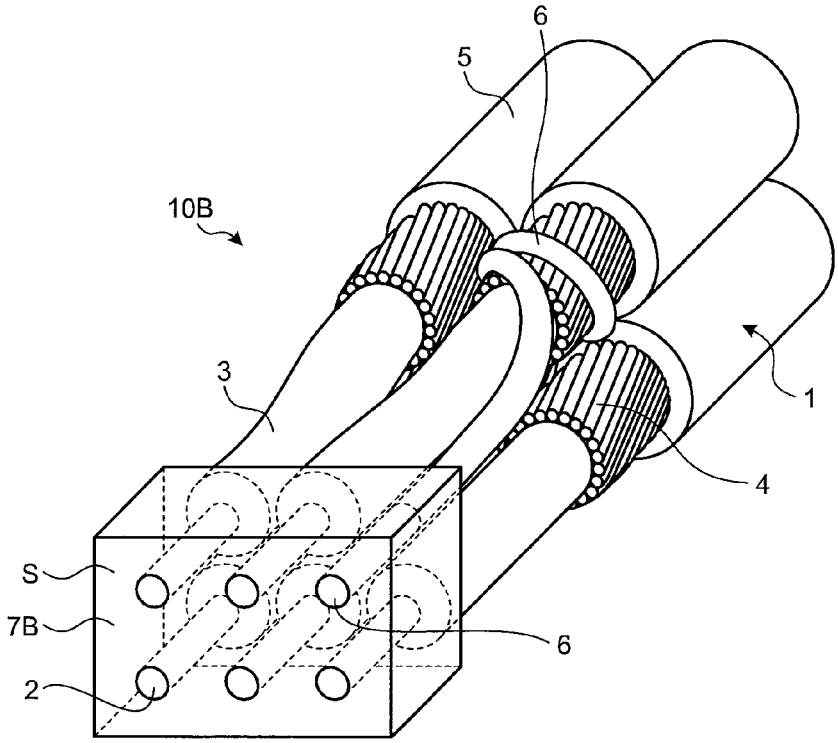
FIG. 4 is a perspective view of a mounting cable according to a second modified example of the first embodiment of the present invention.

Furthermore, the conductor 6 may be wound around and electrically and mechanically connected to the outer periphery portion of the shield 4 of the single coaxial cable 1 among the plurality of coaxial cables 1. FIG. 4 is a perspective view of a mounting cable according to a second modified example of the first embodiment of the present invention. A mounting cable 10B according to the second modified example of the first embodiment of the present invention includes five coaxial cables 1, a conductor 6, and a cable fixing unit 7B. The conductor 6 is wound around and connected to the shield 4 of the single coaxial cable 1. The shields 4 of other four coaxial cables 1 are conductively connected to the conductor 6 by being brought into contact with each other. As in the first embodiment, the mounting cable 10B according to the second modified example can connect the shield 4 to the ground electrode via the conductor 6 having the outer diameter larger than that of the metal wire forming the shield 4. Thus, even when there is a slight positional deviation in the mutual positional relation between the core wire 2 and the conductor 6 exposed on the connection surface S of the cable fixing unit 7B, and the core wire connection electrode and the ground electrode provided on the substrate, it is possible to maintain the connection strength. In addition, since the conductor 6 is spaced apart from the core wire 2 by the cable fixing unit 7B, and the core wire connection electrode is spaced apart from the ground electrode by the cable fixing unit 7B, it is possible to suppress an occurrence of short circuit or the like.

Second Embodiment

Figure 5:
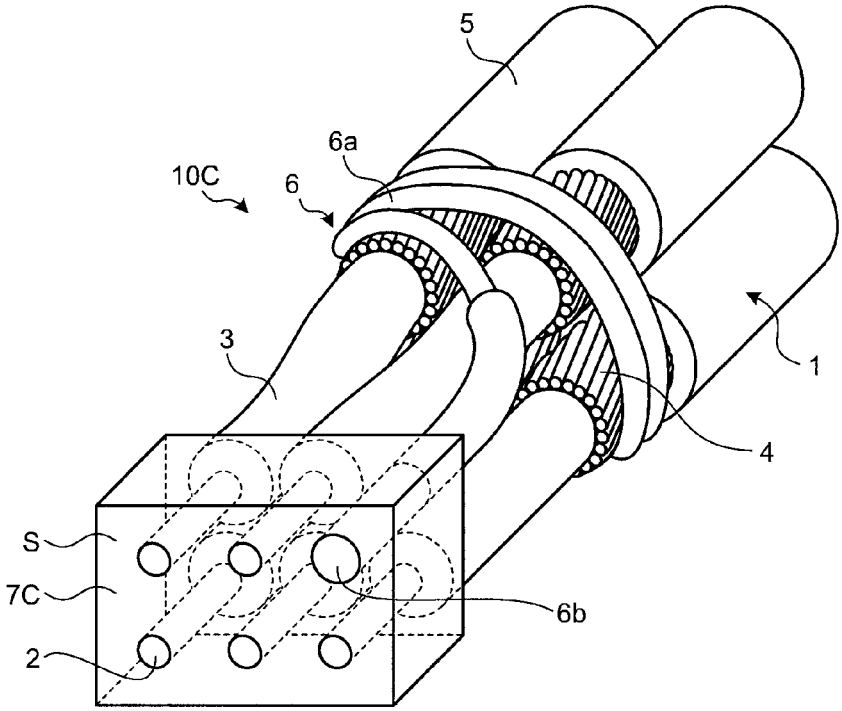
FIG. 5 is a perspective view of a mounting cable according to a second embodiment of the present invention.

In the second embodiment, the conductor includes a first conductor connected to the shield, and a second conductor fixed to a cable fixing unit. FIG. 5 is a perspective view of a mounting cable according to the second embodiment of the present invention.

In a mounting cable 100 according to the second embodiment, the conductor 6 includes a first conductor 6*a* that is wound around and electrically and mechanically connected to the outer periphery portion of the shield 4, and a second conductor 6*b* which is fixed to a cable fixing unit 7C together with the core wire 2 and has an end portion exposed on the connection surface S. As the first conductor 6*a*, a conductor having an outer diameter smaller than the thickness of the jacket 5 is used. Therefore, even if the first conductor 6*a* is disposed, the outermost diameter of the mounting cable 100 does not become larger than the original diameter. As the second conductor 6*b*, a conductor having a diameter larger than that of the first conductor 6*a* is used. As a result, a connection area with the ground electrode increases, and the connection strength can be further improved. The first conductor 6*a* and the second conductor 6*b* can be connected by solder or the like. In addition, by processing a single conductor in which a diameter does not change (stretching by pulling or compressing by striking), it is possible to obtain the first conductor 6*a* and the second conductor 6*b* which are integrated even when not connected by solder or the like.

In the second embodiment, the example using the five coaxial cables 1 is described. However, the first conductor 6*a* may be wound around and connected to the shield 4 of the single coaxial cable 1, and the second conductor 6*b* may be fixed with the core wire 2 by the cable fixing unit 7C. In the mounting cable 100 using a plurality of coaxial cables 1, the first conductor 6*a* may be wound around and connected to the outer periphery portion of the shield 4 of the single coaxial cable 1, and the second conductor 6*b* may be fixed together with the plurality of core wires 2 by the cable fixing unit 7C.

Third Embodiment

Figure 6:
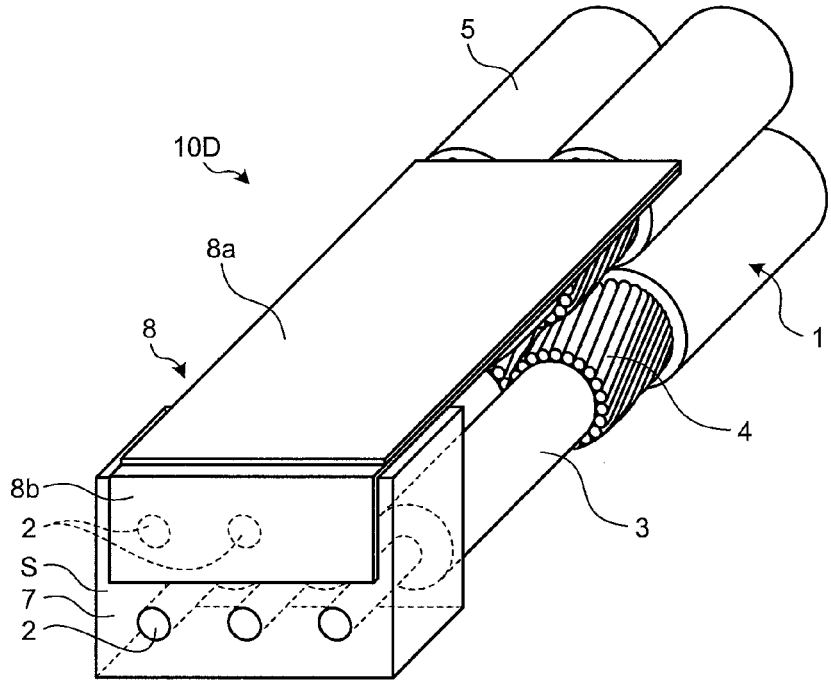
FIG. 6 is a perspective view of a mounting cable according to a third embodiment of the present invention.

In a third embodiment, a flexible printed circuit board (hereinafter, referred to as "FPC board") is used as a conductor. FIG. 6 is a perspective view of a mounting cable according to a third embodiment of the present invention.

In a mounting cable 10D according to the third embodiment, a ground pattern 8*b* having an insulating base material 8*a*, and an FPC board 8 formed on one surface of the base material 8*a* is used as the conductor. The FPC board 8 is disposed such that the ground pattern 8*b* is in contact with the shield 4 and the cable fixing unit 7. One end portion of the ground pattern 8*b* of the FPC board 8 in the longitudinal direction is electrically and mechanically connected to the shield 4. Meanwhile, at the other end portion, the base material 8*a* is removed by methods such as cutting or etching to expose the ground pattern 8*b*, and the exposed ground pattern 8*b* is bent so as to be in contact with the connection surface S, and is connected to the cable fixing unit 7.

In the mounting cable 10D, five coaxial cables 1 are used. However, the two coaxial cables 1, in which the core wire 2 is disposed in the upper stage by the cable fixing unit 7, are ground cables exposed on the connection surface S at the end faces and are electrically and mechanically connected to the ground pattern 8*b*.

In the third embodiment, the ground pattern 8*b* bent to the connection surface S side is connected to the ground electrode of the substrate. Since the ground pattern 8*b* bent toward the connection surface S can be used as an electrode, the connection strength can be improved by increasing the connection area. In addition, since the ground pattern 8*b* bent to the connection surface S side is spaced apart from the end face of the core wire 2 exposed on the connection surface S, it is also possible to suppress the occurrence of a short circuit or the like.

Figure 7:
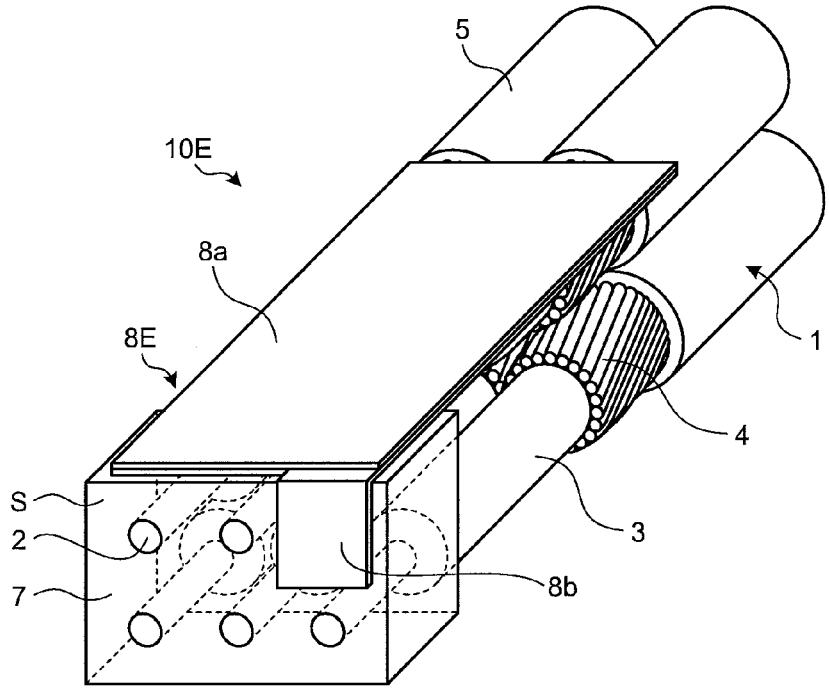
FIG. 7 is a perspective view of a mounting cable according to a first modified example of the third embodiment of the present invention.

In the third embodiment, the core wire 2 of the ground cable and the ground pattern 8*b* are connected to each other, but all the five coaxial cables 1 may be used for signal or power transmission. FIG. 7 is a perspective view of a mounting cable according to a first modified example of the third embodiment of the present invention. In the mounting cable 10E according to the first modified example, the base material 8*a* is removed on the cable fixing unit 7 side of an FPC board 8E to expose the ground pattern 8*b*, and when the ground pattern 8*b* is also bent toward the connection surface S side, the ground pattern 8*b* is removed so as not to come into contact with the core wire 2 exposed on the connection surface S. In the first modified example, it is possible to transmit a signal or power, using more coaxial cables 1, while securing a connection area.

Fourth Embodiment

Figure 8:
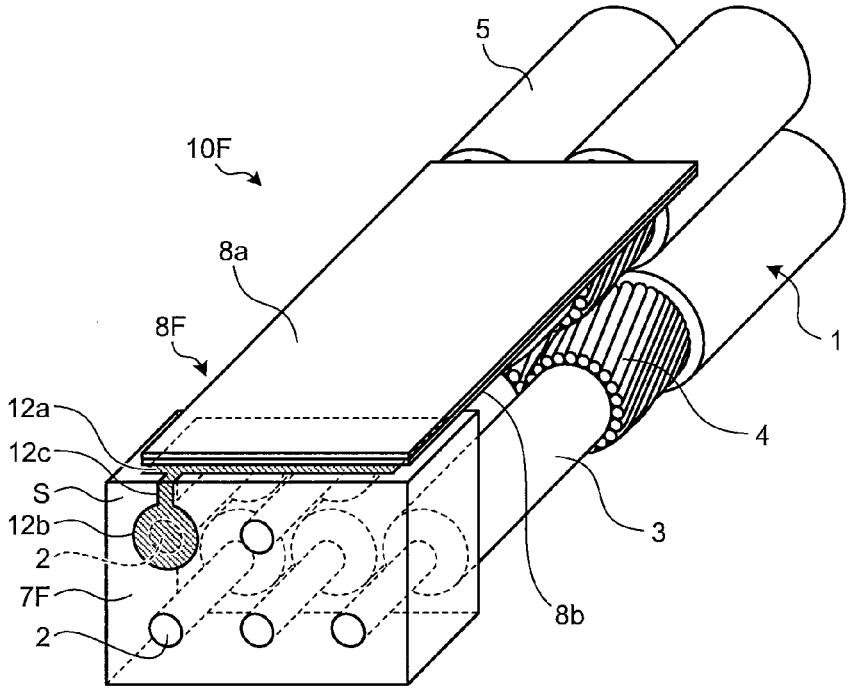
FIG. 8 is a perspective view of a mounting cable according to a fourth embodiment of the present invention.

In the fourth embodiment, a rigid substrate such as a glass epoxy substrate or an FPC board is used as the conductor, and the ground pattern of the substrate is connected to the ground electrode provided in the cable fixing unit. FIG. 8 is a perspective view of the mounting cable according to the fourth embodiment of the present invention.

In a mounting cable 10F according to the fourth embodiment, a substrate 8F having an insulating base material 8*a* and a ground pattern 8*b* formed on one surface of the base material 8*a* is used as the conductor. The substrate 8F is disposed such that the ground pattern 8*b* is in contact with the shield 4 and the cable fixing unit 7F, and the ground pattern 8*b* on the shield 4 side is electrically and mechanically connected to the shield 4.

A first ground electrode 12*a* is provided on a surface (in FIG. 8, the upper surface of the cable fixing unit 7F) of the cable fixing unit 7F that is in contact with the substrate 8F, and a second ground electrode 12*b* is provided on the connection surface S. The ground pattern 8*b* of the substrate 8F is electrically and mechanically connected to the first ground electrode 12*a*, and the second ground electrode 12*b* is connected to the ground electrode of the substrate. The first ground electrode 12*a* and the second ground electrode 12*b* are connected to each other via a wiring pattern 12*c*. The first ground electrode 12*a*, the second ground electrode 12*b*, and the wiring pattern 12*c* can be manufactured, by fixing the core wire 2 by the cable fixing unit 7F, cutting and polishing the connection surface S such that the core wire 2 is exposed, then forming a metal or alloy layer on the entire surface of the cable fixing unit 7F by the plating treatment or the like, and thereafter, providing the first ground electrode 12*a*, the second ground electrode 12*b* and the wiring pattern 12*c* by etching or the like.

In the mounting cable 10F, the five coaxial cables 1 are used. However, the coaxial cable 1, in which the core wire 2 is directed by the cable fixing unit 7F and is disposed on the upper left side, is a ground cable which is exposed on the connection surface S at the end face and is electrically and mechanically connected to the second ground electrode 12*b*.

In the fourth embodiment, the ground pattern 8*b* is connected to the first ground electrode 12*a* formed on the upper surface of the cable fixing unit 7F, and the second ground electrode 12*b* formed on the connection surface S is connected to the ground electrode of the substrate. Since the second ground electrode 12*b* is used as an electrode, it is possible to improve the connection strength by an increase in the connection area. Further, when the first ground electrode 12*a*, the second ground electrode 12*b*, and the wiring pattern 12*c* are formed by plating or the like, the thicknesses of the first ground electrode 12*a*, the second ground electrode 12*b*, and the wiring pattern 12*c* can be made thin. Thus, it is possible to reduce a difference in height from the core wire 2 exposed on the connection surface S, and the connection to the substrate can be easily performed. Furthermore, since the second ground electrode 12*b* is spaced apart from the end face of the core wire 2 exposed on the connection surface S, the occurrence of a short circuit or the like can also be suppressed.

In the fourth embodiment, the second ground electrode 12*b* is provided on the core wire 2 of the ground cable, but the second ground electrode 12*b* is formed on the upper right side of the connection surface S to which the end portion of the core wire 2 is not exposed, and all the five coaxial cables 1 can be used for signal or power transmission.

Fifth Embodiment

Figure 9:
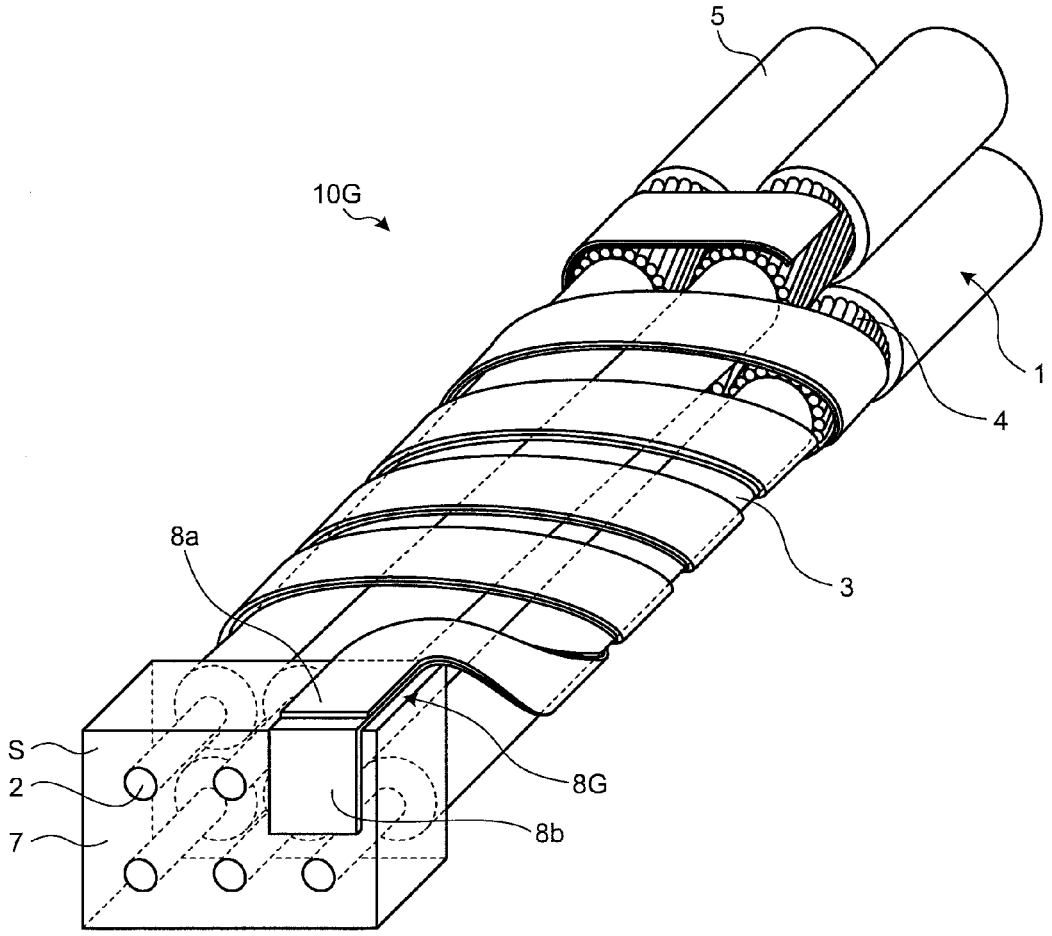
FIG. 9 is a perspective view of a mounting cable according to a fifth embodiment of the present invention.

In the fifth embodiment, an FPC board used as a conductor is wound around an outer periphery of the exposed internal insulator. FIG. 9 is a perspective view of a mounting cable according to the fifth embodiment of the present invention.

In a mounting cable 10G according to the fifth embodiment, an FPC board 8G having an insulating base material 8*a* and a ground pattern 8*b* formed on one surface of the base material 8*a* is used as the conductor. The FPC board 8G is spirally wound around the outer periphery of the exposed internal insulator 3, one end portion thereof in the longitudinal direction is electrically and mechanically connected to the shield 4 via the ground pattern 8*b*, and the other end portion thereof is bent and connected to the cable fixing unit 7 so that the exposed ground pattern 8*b* comes into contact with the connection surface S by removing the base material 8*a* by cutting or etching.

In the fifth embodiment, since the outer periphery of the internal insulator 3 not protected by the shield 4 is spirally wound by the FPC board 8G, it is possible to obtain a shielding effect of the FPC board 8G. In addition, since the ground pattern 8*b* bent to the connection surface S is connected to the ground electrode of the substrate, the connection strength can be improved. Furthermore, since the ground pattern 8*b* bent to the connection surface S is spaced apart from the end face of the core wire 2 exposed on the connection surface S, it is also possible to suppress an occurrence of short circuit or the like.

Sixth Embodiment

Figure 10:
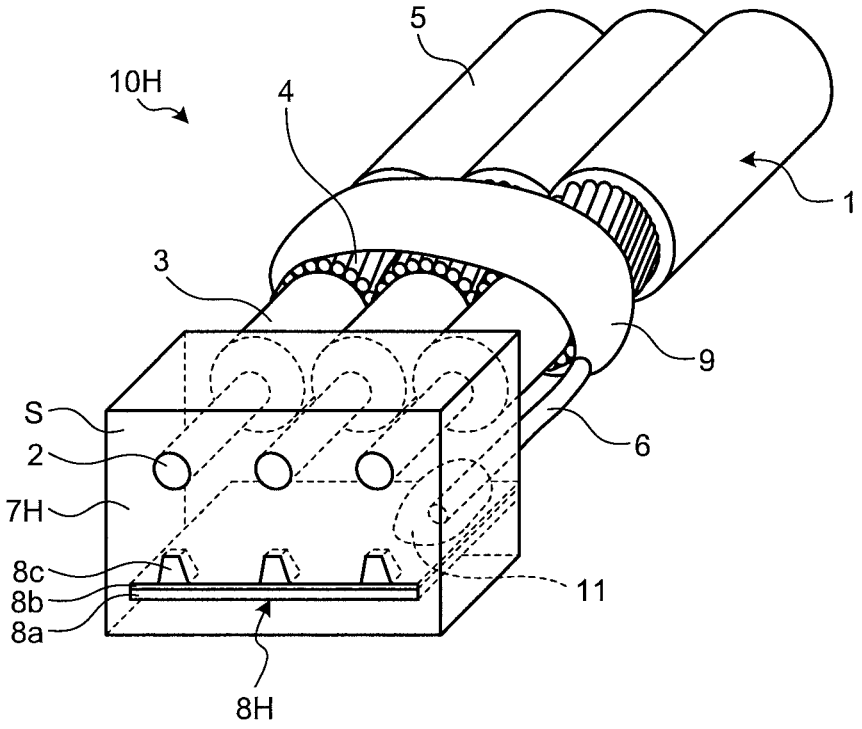
FIG. 10 is a perspective view of a mounting cable according to a sixth embodiment of the present invention.

In the sixth embodiment, a rigid substrate such as a glass epoxy substrate or an FPC board is used as a conductor, a bump is formed at an end portion of the substrate, and the formed bump is exposed on the connection surface and used as an electrode. FIG. 10 is a perspective view of a mounting cable according to a sixth embodiment of the present invention.

In a mounting cable 10H according to the sixth embodiment, the end portion of the conductor 6 is wound around the outer periphery of the exposed shields 4 of the three coaxial cables 1, and the shield 4 and the conductor 6 are electrically and mechanically connected to each other by a solder 9. The other end of the conductor 6 is electrically and mechanically connected onto the ground pattern 8*b* of a substrate 8H by a solder 11.

A cable fixing unit 7H fixes the exposed core wire 2 and the substrate 8H. The end portion of the core wire 2 and the end face on which a bump electrode 8*c* of the substrate 8H is provided are exposed on the connection surface S.

Figure 11:
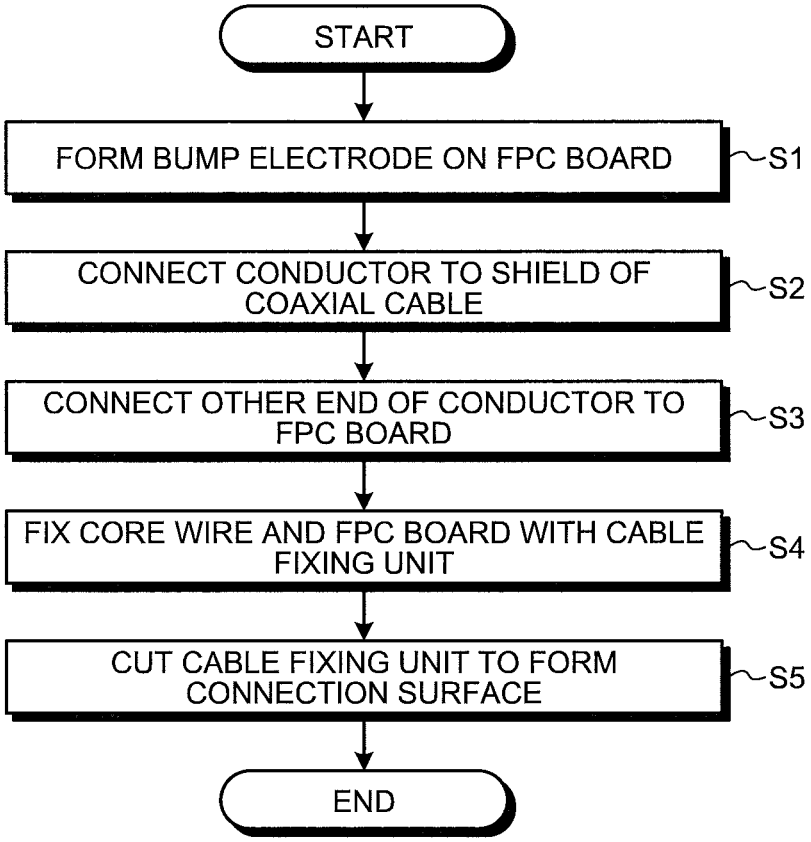
FIG. 11 is a flowchart illustrating a manufacturing process of the mounting cable according to the sixth embodiment of the present invention.
Figure 12A:
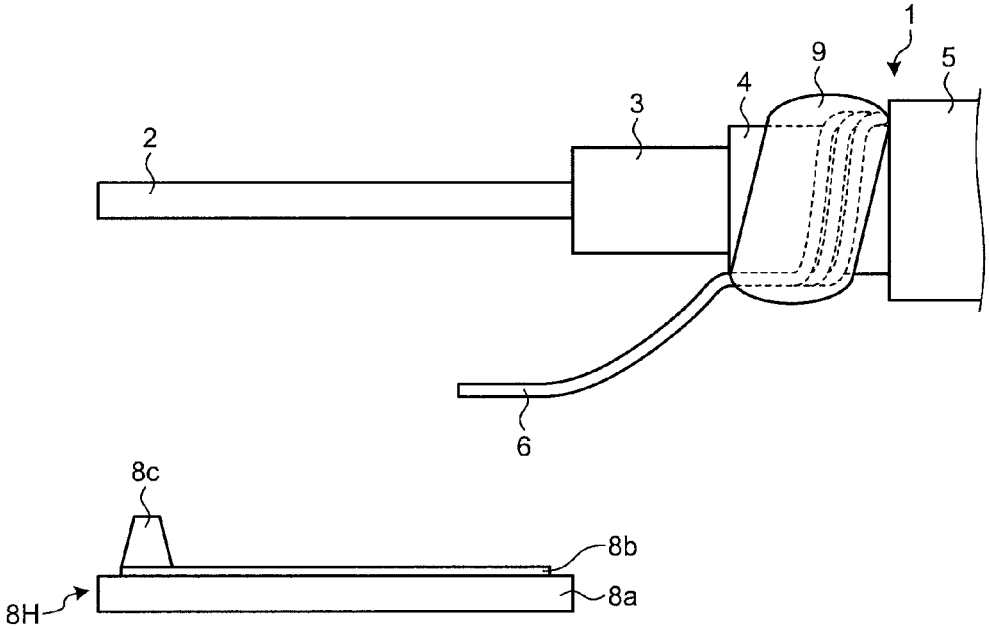
FIG. 12A is a side view illustrating a manufacturing process of the mounting cable according to the sixth embodiment of the present invention.
Figure 12B:
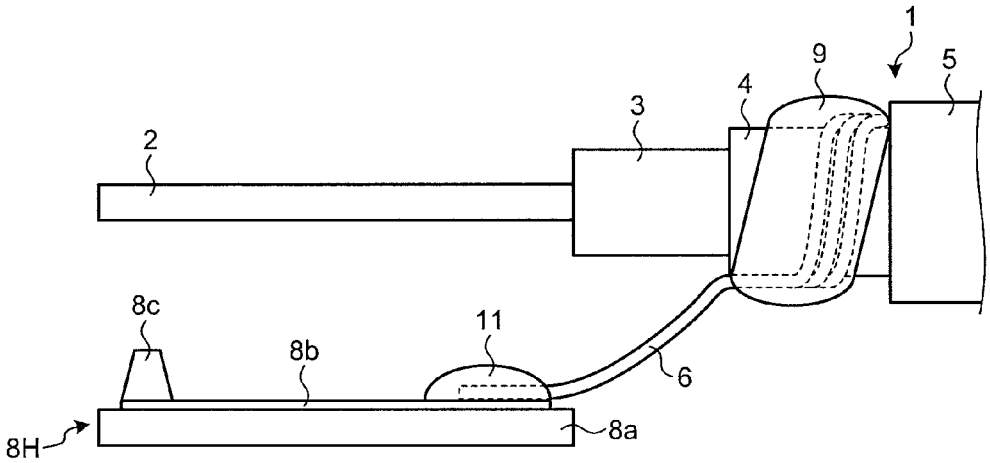
FIG. 12B is a side view illustrating a manufacturing process of the mounting cable according to the sixth embodiment of the present invention.
Figure 12C:
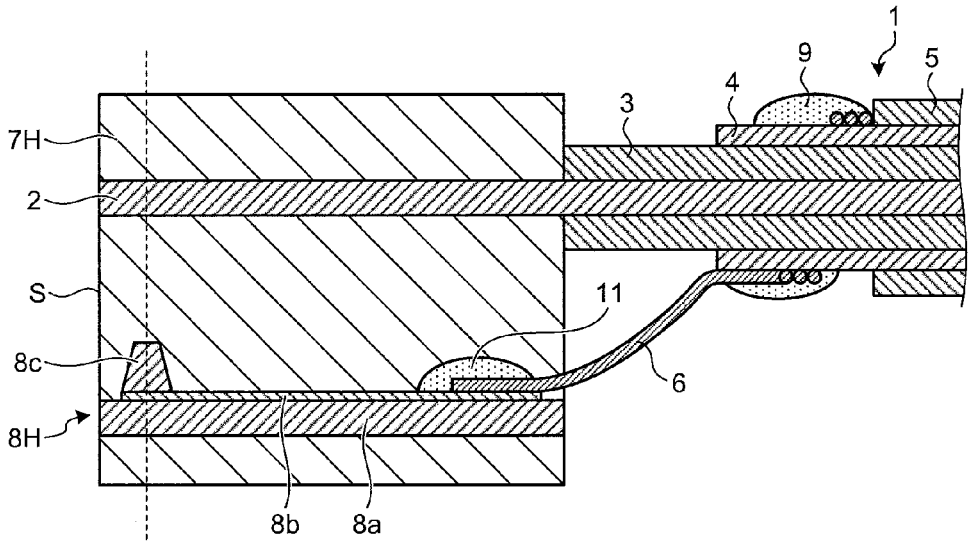
FIG. 12C is a cross-sectional view illustrating a manufacturing process of the mounting cable according to the sixth embodiment of the present invention.
Figure 12D:
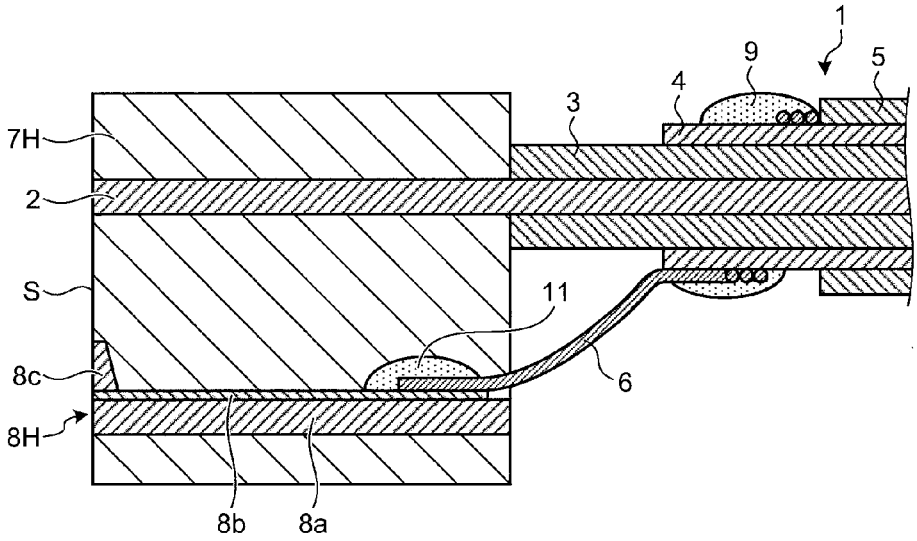
FIG. 12D is a cross-sectional view illustrating a manufacturing process of the mounting cable according to the sixth embodiment of the present invention.

Next, a method for manufacturing the mounting cable 10H will be described with reference to the drawings. FIG. 11 is a flowchart illustrating a manufacturing process of the mounting cable 10H according to the sixth embodiment of the present invention. FIGS. 12A and 12B are side views illustrating the manufacturing process of the mounting cable 10H according to the sixth embodiment of the present invention, and FIGS. 12C and 12D are cross-sectional views illustrating the manufacturing process of the mounting cable 10H.

First, as illustrated in FIG. 12A, the bump electrode 8*c* is formed on the ground pattern 8*b* of the substrate 8H (step S1). The bump electrodes 8*c* can be formed by solder connection of the conductors, besides stud bumps, plating bumps and the like.

The core wire 2, the internal insulator 3 and the shield 4 of the coaxial cable 1 are exposed using a laser processing machine or the like, and the conductor 6 is wound around the outer periphery of the exposed shield 4 and connected by solder 9 or the like (step S2).

Next, as illustrated in FIG. 12B, the other end of the conductor 6 with the end portion connected to the outer periphery of the shield 4 in step S2 is connected to the other end of the substrate 8H formed with the bump electrode 8*c*, by the solder 11 or the like (step S3).

As illustrated in FIG. 12C, after the substrate 8H to which the conductor 6 is connected and the core wire 2 are disposed in a mold and the positions thereof are adjusted, resin serving as a material of the cable fixing unit 7 is filled and cured, and the core wire 2 and the substrate 8H are fixed by the cable fixing unit 7H (step S4).

At the position indicated by the dotted line in FIG. 12C, the cable fixing unit 7H is cut using a dicing saw or the like (step S5), and as illustrated in FIG. 12D, it is possible to manufacture the mounting cable 10H in which the core wire 2 and the bump electrode 8*c* are exposed on the connection surface S. The core wire 2 and the bump electrode 8*c* exposed on the connection surface S are connected to the core wire connection electrode and the ground electrode of the substrate, respectively. In the cutting process of step S5, the end face may be polished.

In the sixth embodiment, the shield 4 is connected to the ground electrode of the substrate via the conductor 6, the ground pattern 8*b*, and the bump electrode 8*c*. Since it is possible to increase the connection area by the bump electrode 8*c*, the connection strength can be improved. In addition, since the bump electrode 8*c* is embedded in the cable fixing unit 7H, there is no difference in height from the core wire 2 exposed on the connection surface S, and the connection to the substrate can be easily performed. Furthermore, since the bump electrode 8*c* is spaced apart from the end face of the core wire 2 exposed on the connection surface, it is possible to suppress the occurrence of a short circuit or the like.

Seventh Embodiment

Figure 13:
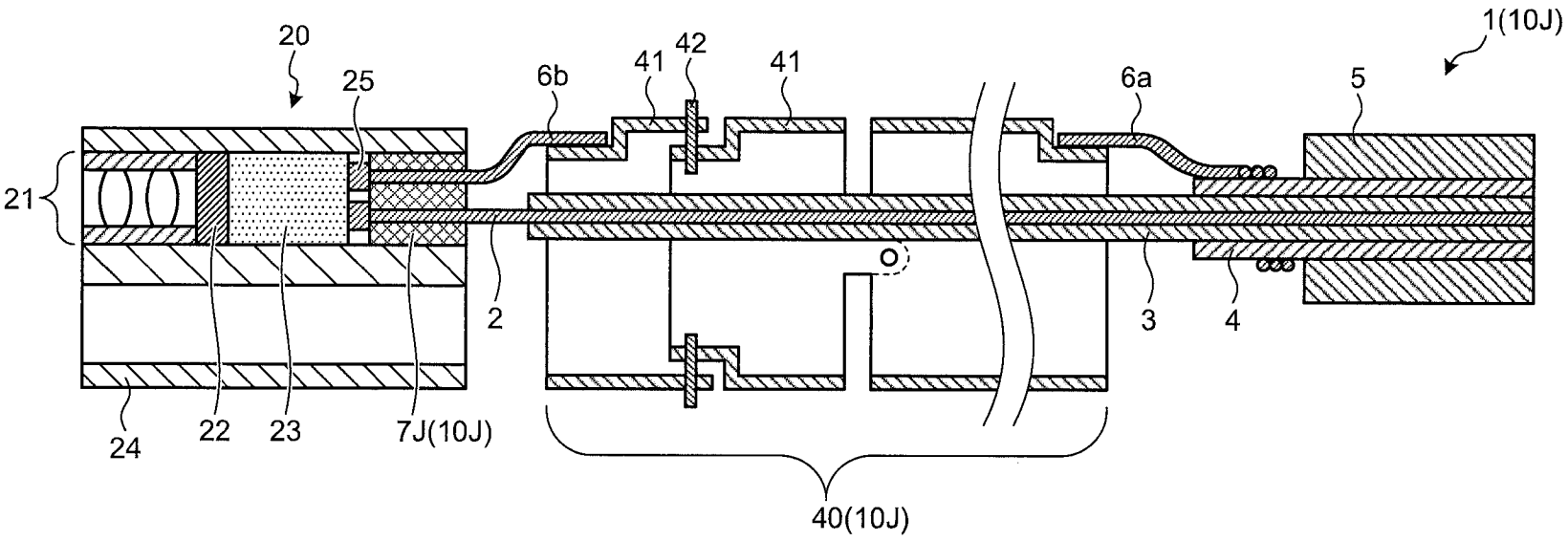
FIG. 13 is a cross-sectional view of an endoscope distal end portion using a mounting cable according to a seventh embodiment of the present invention.

A mounting cable according to a seventh embodiment is used at a distal end portion of an endoscope. FIG. 13 is a cross-sectional view of the endoscope distal end portion which uses the mounting cable according to the seventh embodiment of the present invention.

A mounting cable 10J according to the seventh embodiment includes a coaxial cable 1, a first conductor 6*a*, a bending tube 40, a second conductor 6*b*, and a cable fixing unit 7J.

One end of the first conductor 6*a* is wound around the outer periphery of the exposed shield 4 and is electrically and mechanically connected to the shield 4 by a solder (not illustrated) or the like. The other end of the first conductor 6*a* is electrically and mechanically connected to the rear end portion of the bending tube 40 by a solder (not illustrated) or the like.

The bending tube 40 has a hollow interior and is formed by connecting a plurality of metal bending pieces 41 by rivets 42. Along with pulling and relaxation of a bending wire (not illustrated) passing through the inside of the bending tube 40, the bending tube 40 is freely bent in four up, down, left and right directions. Inside the bending tube 40, the coaxial cable 1 from which a shield 4 and a jacket 5 are peeled is inserted, while exposing the internal insulator 3. Although not clearly illustrated in FIG. 13, the outer periphery of the coaxial cable 1, the bending tube 40, and a distal end portion casing 24 to be described later are covered with an outer skin such as a waterproof rubber tube.

One end of the second conductor 6*b* is electrically and mechanically connected to the distal end portion of the bending tube 40 by a solder (not illustrated) or the like. The other end of the second conductor 6*b* and the core wire 2 are fixed together by the cable fixing unit 7J.

An imaging unit 20 includes a lens unit 21, an image sensor 22, and a substrate 23. The core wire 2 and the second conductor 6*b* exposed on the connection surface of the cable fixing unit 7J are end-connected to the core wire connection electrode and the ground electrode provided in the substrate 23 via a connection material 25. The lens unit 21, the image sensor 22, and the substrate 23 are fixed to the distal end portion casing 24 via a holder (not illustrated).

In the seventh embodiment, the shield 4 is connected to the ground electrode of the substrate via the first conductor 6*a*, the bending tube 40, and the second conductor 6*b*. Since the coaxial cable 1 in a state in which the internal insulator 3 is exposed is shielded by the bending tube 40, a signal with less noise can be transmitted. Further, since the second conductor 6*b* is embedded in the cable fixing unit 7J inside the bending tube 40, there is no difference in height from the core wire 2 exposed on the connection surface S, and connection to the substrate can be easily performed. Furthermore, since the second conductor 6*b* is spaced apart from the end face of the core wire 2 exposed on the connection surface, it is possible to suppress the occurrence of short circuit or the like.

According to some embodiments, when connecting the shield of the coaxial cable with the reduced diameter to the substrate, it is possible to maintain the connection strength and to suppress an occurrence of a short circuit or the like by securing a connection area.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mounting cable comprising:

a coaxial cable including: a core wire made of a conductive material; an internal insulator covering an outer periphery of the core wire; a shield covering an outer periphery of the internal insulator; and a jacket covering an outer periphery of the shield with an insulator, the coaxial cable having one end portion on which the core wire, the internal insulator and the shield are exposed;

a cable fixing unit that fixes one end portion of the exposed core wire and has a connection surface on which an end face of the core wire is exposed; and a conductor having one end electrically and mechanically connected to the exposed shield and having another end fixed to the cable fixing unit, wherein an end portion of the conductor is exposed on the connection surface of the cable fixing unit.

2. The mounting cable according to claim 1, wherein the cable fixing unit fixes the core wire and the conductor at a predetermined interval, and the end face of the core wire and an end face of the conductor are exposed on the connection surface.

3. The mounting cable according to claim 2, wherein the conductor comprises:

a first conductor connected to the shield; and a second conductor connected to the first conductor and fixed by the cable fixing unit, the second conductor having an end face exposed on the connection surface of the cable fixing unit, wherein the second conductor is larger in diameter than the first conductor.

4. The mounting cable according to claim 1, wherein the conductor is a substrate having an insulating base material and having a ground pattern formed on one surface of the insulating base material, wherein the substrate is disposed such that the ground pattern is in contact with the shield and the cable fixing unit, the substrate has one end portion in a longitudinal direction, connected to the shield, the substrate has another end portion where part of the insulating base material is removed to expose the ground pattern, and the exposed ground pattern is bent so as to be in contact with the connection surface to connect another end portion to the cable fixing unit.

5. The mounting cable according to claim 1, wherein the conductor is a substrate having an insulating base material and having a ground pattern formed on one surface of the insulating base material, the substrate is disposed such that the ground pattern is in contact with the shield and the cable fixing unit, the substrate has one end portion in a longitudinal direction, connected to the shield, the mounting cable further comprises:

a first ground electrode formed on a surface of the cable fixing unit being in contact with the substrate;

a second ground electrode formed on the connection surface; and a wiring pattern by which the first ground electrode and the second ground electrode are connected to each other, wherein the ground pattern is connected to the first ground electrode.

6. The mounting cable according to claim 1, wherein the conductor is a substrate having an insulating base material and having a ground pattern formed on one surface of the insulating base material, the mounting cable further comprises a bump electrode formed on the ground pattern on one end portion of the substrate, the one end portion of the substrate is fixed together with the core wire by the cable fixing unit, the bump electrode is exposed on the connection surface, and the ground pattern is connected to the shield at another end portion of the substrate.

7. The mounting cable according to claim 4, wherein the substrate is a belt-shaped flexible printed circuit board that is spirally wound around the outer periphery of the exposed internal insulator.

8. The mounting cable according to claim 5, wherein the substrate is a belt-shaped flexible printed circuit board that is spirally wound around the outer periphery of the exposed internal insulator.

9. The mounting cable according to claim 6, wherein the substrate is a belt-shaped flexible printed circuit board that is spirally wound around the outer periphery of the exposed internal insulator.

10. A method for manufacturing a mounting cable, the method comprising:

forming a bump electrode on an end portion of a substrate, the substrate having an insulating base material and having a ground pattern on one surface of the insulating base material;

electrically and mechanically connecting one end of a conductor to a shield of a coaxial cable, the coaxial cable having a core wire, an internal insulator and the shield and having one end portion on which the core wire, the internal insulator and the shield are exposed;

connecting another end of the conductor to the ground pattern of the substrate;

fixing the core wire and the substrate with a cable fixing unit after aligning the core wire and the substrate; and cutting the cable fixing unit to expose the core wire and the bump electrode.

* * * * *